United States Patent [19]

Luedtke et al.

[11] 4,103,373

[45] Aug. 1, 1978

[54] PORTABLE FOLDING BED CABINET

[76] Inventors: Oscar F. Luedtke; Sarah Luedtke, both of 1636 Jasper Ave., Chula Vista, Calif. 92011

[21] Appl. No.: 793,916

[22] Filed: May 5, 1977

[51] Int. Cl.[2] ..... A47C 17/40

[52] U.S. Cl. ..... 5/166 R; 5/9 R; 5/147

[58] Field of Search ..... 5/2 B, 8, 9 R, 146, 5/147, 164 R, 164 C, 166 R; 52/36

[56] References Cited

U.S. PATENT DOCUMENTS

| | | | |
|---|---|---|---|
| 297,256 | 4/1884 | Hale | 5/9 R |
| 2,528,307 | 10/1950 | Heaney | 5/9 R |
| 2,550,599 | 4/1951 | Reed | 5/9 R |
| 3,811,138 | 5/1974 | Del Missier | 5/9 R |
| 3,829,907 | 8/1974 | Brunner | 5/9 R |

*Primary Examiner*—Kenneth Downey
*Assistant Examiner*—Alex Grosz
*Attorney, Agent, or Firm*—Charles C. Logan, II

[57] ABSTRACT

A portable folding bed cabinet having a vertically elongated frame and a pair of horizontally spaced mattress frames that are attached to the vertically elongated frame. The vertically elongated frame has vertical side frame members having tracks along their inner surfaces for guiding counterweight panels that extend across the back of the vertically elongated frame. The counterweight panels are connected at their opposite ends to the mattress frames by a pair of link arms. The link arms are pivotally attached to each other with one link arm pivotally connected to the counterweight panel and the other link arm fixedly attached to the mattress frame. A leg assembly is also attached to the opposite ends of the lower mattress frame and these leg assemblies retract when the mattress frame is folded into its upright stored position. Each leg assembly has a leg and a pair of link arm members. The legs are in the form of bellcranks that are pivotally mounted at their centers on a shaft that passes through the mattress frame into cam members mounted on the inner surface of the mattress frames. As the bellcrank shaped legs are pivoted around their shafts, they withdraw into recesses formed into the end of the mattress frame. A retainer frame is detachably secured to the top mattress frame. A ladder has pins extending from the rear surface that interlock in slots formed in the mattress frames to function as a brace member and also a means of access to the upper bed.

7 Claims, 5 Drawing Figures

PORTABLE FOLDING BED CABINET

BACKGROUND OF THE INVENTION

The present invention relates to a bed and in particular to a portable folding bed contained within its own cabinet. In the past, most beds consisted of a horizontally elongated frame upon which a mattress is placed. These beds take up a large portion of the floor space of a bedroom. The problem of how much space is taken up by the bed has become more pronounced in recent years due to the high cost of constructing homes and the fact that bedrooms are being made smaller and smaller. As a result, many families have switched to bunk beds to conserve open or play space for their children. The use of a bunk bed results in a saving of at least half the square footage that a normal bed would take.

Also, in the past, beds that folded up into the wall, called Murphy beds, were used in hotels and apartments. These beds were fairly complicated in their structure, occupied considerable wall space and were fixed in place and could not be moved about the room.

It is an object of the invention to provide a collapsible bed that will save space in the bedroom.

It is also an object of the invention to provide a collapsible bed that is portable or movable within the room or to another room.

It is also an object of the invention to provide a folding bed that can be easily disassembled for shipping or storage.

It is a further object of the invention to provide a folding bed that can be easily and safely operated by children.

It is a further object of the invention to provide an attractive piece of furniture in which the folding bed can be stored with everything out of sight.

It is an additional object of the invention to provide a novel bunk bed that allows one of the beds to be used while the other is folded up out of the way.

SUMMARY OF THE INVENTION

The novel portable bed cabinet has a vertically elongated frame with at least one mattress frame pivotally attached to the vertically elongated frame. Counterweight panels extend horizontally across the back of the vertically elongated frame and have their ends inserted into tracks formed along the inner surfaces of the vertical side frame members. These tracks act as guides for the ends of the counterweight panels as they are raised and lowered in response to pivoting the mattress frame from a vertical position to a horizontal position. The counterweight panels are connected at their ends to the mattress frame by a pair of link arms. The link arms are pivotally attached to each other with one link arm pivotally connected to the counterweight panels and the other link arm fixedly attached to the mattress frame. The use of the counterweights facilitate the opening and closing of the mattress frame. The counterweight panels function to also keep the major portion of the weight of the portable folding cabinet to the rear of its center of gravity and in close proximity to the back of the cabinet that would normally be placed against the wall.

The lower bed frame has a leg assembly attached to its opposite ends that functions to support the bed frame on the floor. Each leg assembly has a leg in the shape of a bellcrank and a pair of link arm members. The bellcrank shaped leg is pivotally mounted at its center on a shaft that passes through the mattress frame and into cam structure that is mounted on the inner surface of the mattress frame. The mattress frame has a recess formed into each of the opposite ends into which the legs withdraw when the mattress frame is pivoted to its vertical stored position.

The novel portable folding bed structure can be utilized with either a single full size bed, or with two bunk beds. With either structure, you have an attractive piece of furniture that can be moved anywhere around the bedroom that functions as a bed when the mattress frames are pivoted down into a horizontal position. When the beds are not needed, the mattress frames are folded up to provide the bedroom with maximum floor space for living.

DESCRIPTION OF THE PREFERRED EMBODIMENT

Figure 1:
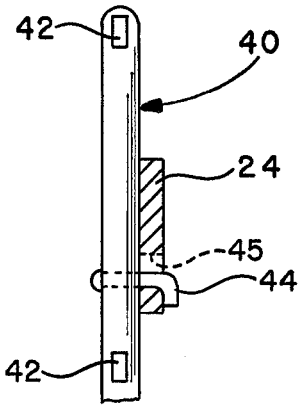
FIG. 1 is a perspective view illustrating the novel, portable folding bed cabinet, with the mattress frames in their retracted positions.
Figure 1:
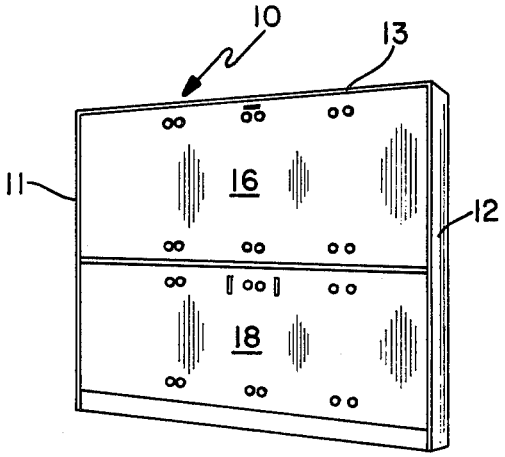
Figure 2:
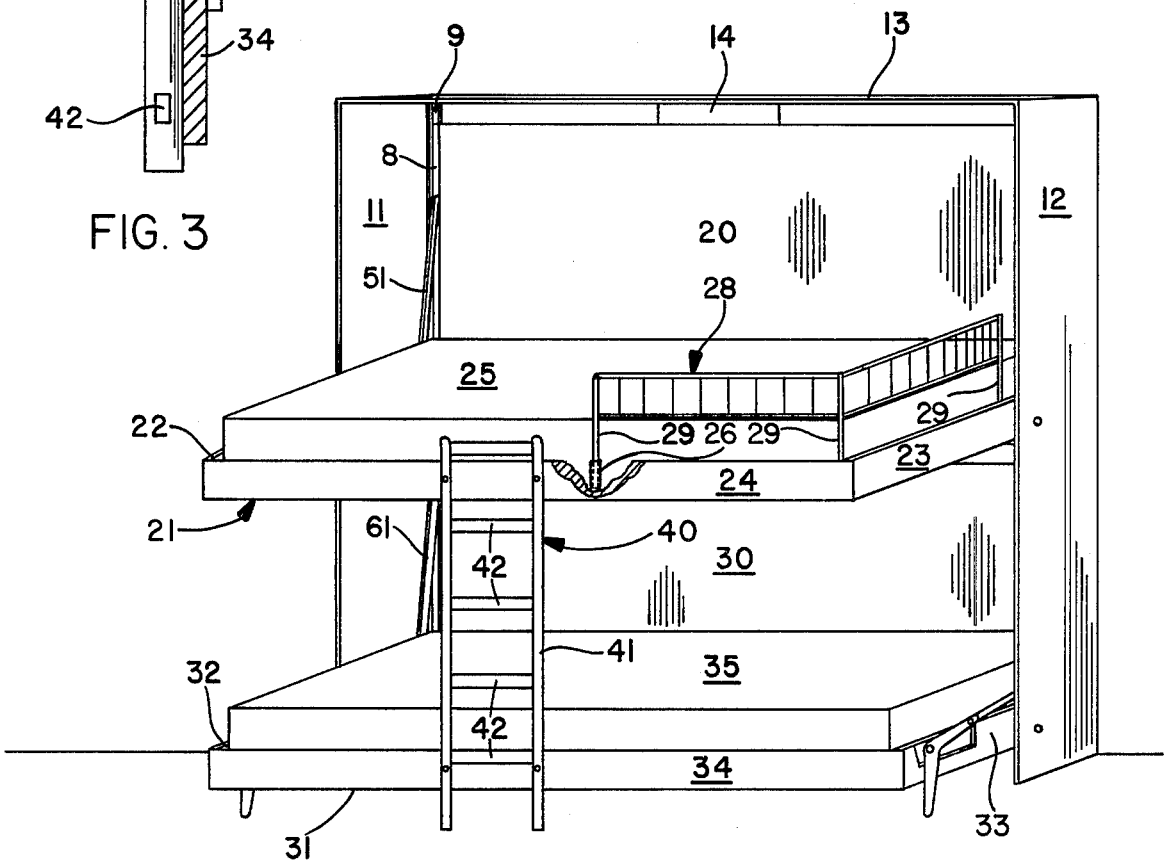
FIG. 2 is a perspective view illustrating the novel, portable folding bed cabinet with the mattress frames folded down in their horizontal position.

Referring to FIGS. 1 and 2, the novel, portable folding bed cabinet will be described. The folding bed cabinet is generally designated numeral 10. It has a vertically elongated frame having vertical side frame members 11 and 12, horizontal top frame member 13 and horizontal bottom frame member 15. The top and side frame members are attached to each other by a tongue and groove structure thus making them easily disassemblable for moving and packaging. It is to be understood than any general fastening means may be used to assemble the frame together. A vertical brace board 14 and a horizontal brace board (not shown) along the back of the cabinet can be used to add further rigidity to the frame.

The front of the cabinet has vertical front panels 16 and 18 that form the bottom of mattress frames 21 and 31. When the mattress frames are in their vertical stored position, the bed is a handsome piece of furniture that adds to the grace of the room.

The top mattress frame 21 is pivotally secured to the vertical side frame members 17. The upper mattress frame has a pair of side walls 22 and 23 and a front wall 24. A mattress 25 rests on the top mattress frame and it may or may not have a metal spring frame positioned under the top mattress frame. A retainer 28 has legs 29 that are received within tubes 26 that are secured to the inner surface of front wall 24. The retainer function is to prevent a person or child from rolling off the top of the mattress 25.

Figure 4:
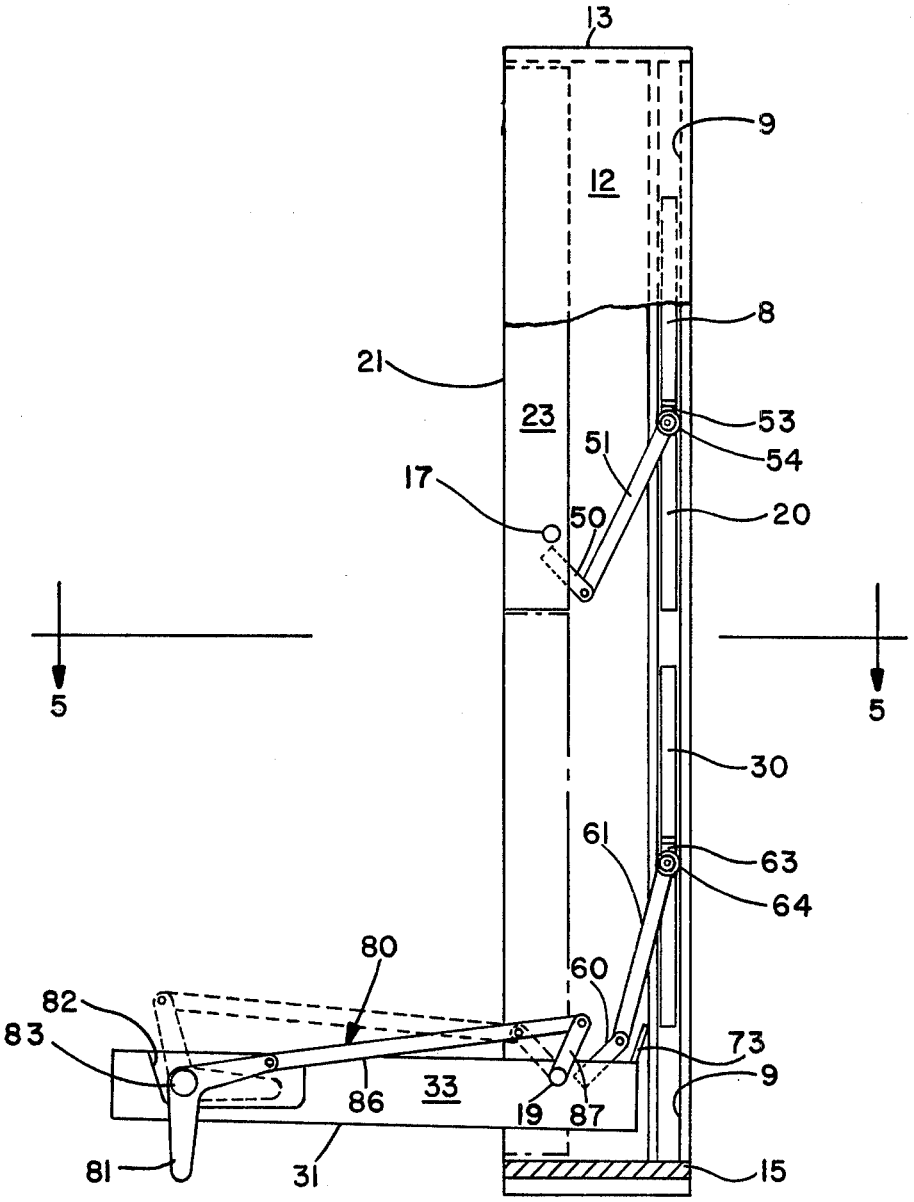
FIG. 4 is a side elevational view of the portable folding bed cabinet with a portion broken away.

The manner in which the top mattress frame is hinged to the cabinet frame and how it is secured to counterweight panel 20 will be best described by viewing FIGS. 2 and 4. The counterweight panel 20 is an elongated metal member that stretches the full width of the cabinet frame and it has arms 8 at each end that fit into tracks 9 formed along the inner surfaces of the vertical side frame members 11 and 12 for guiding the counterweight panels as they are raised and lowered. A pair of link arms 50 and 51 are pivotally attached to each other with one end of link arm 51 being pivotally attached to L-shaped bracket 53 that supportably contact the underside of arms 8 of counterweight panel 20. The pins that pass through the end of links 51 and brackets 53 also have rollers 54 mounted on them that ride up and down in tracks 9. Link arms 50 have their ends fixedly secured to the inner surface of the top mattress frame 21. It will be readily apparent that as top mattress frame 21 is pivoted downwardly from its vertical position to a horizontal position around pins 17 that counterweight panel 20 will be raised vertically along tracks 9. Conversely, counterweight panel 20 will travel downwardly along tracks 9 when the top mattress frame is pivoted upwardly into its stored, vertical position. Each counterweight panel facilitate the opening and closing of the top frame.

The lower bed frame 31 functions in the same manner as the previously described top bed frame 21. The bottom frame has side walls 32 and 33 and a front wall 34. The mattress 35 is located on the frame. Link arms 60 and 61 connect the bottom bed frame to the L-shaped brackets 63 supportably contacting the underside of arms 8 of counterweight panel 30. Element 64 is a roller that travels upwardly and downwardly in tracks 9. The surfaces of the counterweight panels can be attractively covered with contact paper to give the impression that they are wooden panels.

Figure 5:
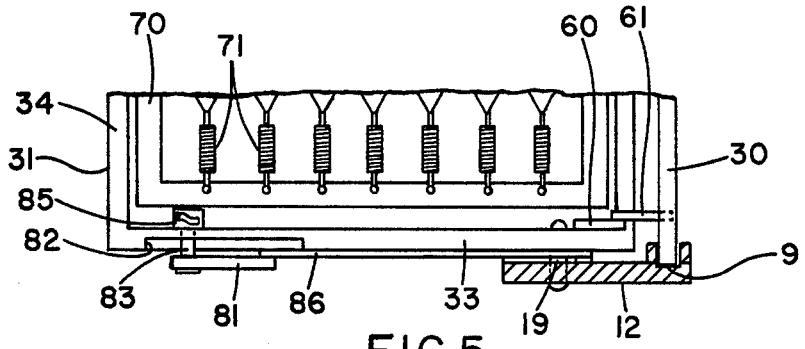
FIG. 5 is a partial top plan view of the bottom mattress frame taken along lines 5—5 of FIG. 4.

Bottom bed frame 31 (see FIG. 5) has a spring frame 70 with springs 71 mounted in its interior. As mentioned previously, the use of a spring frame is optional. A plurality of vertical boards 73 on the back wall of the bottom frame act to restrict the mattress 35 and keep it from being slid off the back of the bottom bed frame. Bottom bed frame 31 also has a leg assembly 80 that functions to help support the bottom bed frame when it is extended in its horizontal position. The leg assembly has a bellcrank shaped leg 81 that is mounted on a shaft 83 passing through side wall 33. The shaft 83 has its end inserted into a cam structure 85 attached to the inner surface of wall 33. A pin 84 extending radially from shaft 83 travels in the cam structure 85 when leg 81 is pivoted. The cam causes the leg 81 to retract into recess 82 formed in side wall 33 when the bottom bed frame is in its retracted position. This result is produced by link arm 86 which is pivotally attached to link arm 86 and also to pin 19. The dotted lines illustrated in FIG. 4 show the position of the leg when the bottom bed frame is retracted to its vertical position.

Figure 3:
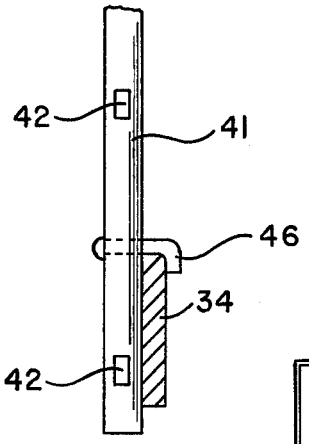
FIG. 3 is a side elevational view illustrating the manner in which the ladder acts as a reinforcing member when it is attached to the upper and lower mattress frames.

Ladder 40 will be described by referring to FIGS. 2 and 3. The ladder 40 has vertical frame members 41 and cross-rungs 42. A plurality of L-shaped pins extend through the ladder and function to interlock with the front walls 24 and 34 of the top mattress frame 21 and bottom mattress frame 31. The front wall 24 has a plurality of apertures 45 into which the L-shaped pins 44 are inserted. At that time, pins 46 would be positioned above front wall 34. After the pins 44 have been inserted into apertures 45, the ladder is moved downwardly to lock the pins 44 and 46 respectively to the front wall members 24 and 34. The ladder, therefore, functions to structurally support the front surface of the top bed frame and also provides access to the top bed frame by a child when it is time to go to bed.

What is claimed is:

1. A portable folding bed cabinet comprising:

a vertically elongated frame;

at least one mattress frame;

means pivotally attaching said mattress frame to said vertically elongated frame:

counterweight means connected to said mattress frame;

said vertically elongated frame comprising a pair of vertical side frame members connected together by a top frame member, said vertical side frame members having track means along their innersurfaces for guiding said counterweight means as they are raised and lowered when said mattress frame is pivoted from a vertical position to a horizontal position; and said counterweight means being elongated panels that extend across the back of said vertically elongated frame with their ends inserted into said track means.

2. A portable folding bed cabinet as recited in claim 1, wherein said counterweight means are connected at each end to said mattress frame by a pair of link arms, said link arms are pivotally attached to each other and one link arm is pivotally connected to said counterweight means and the other link arm is fixedly attached to said mattress frame.

3. A portable folding bed cabinet as recited in claim 2, further comprising leg assembly means having a leg and a pair of link arm members.

4. A portable folding bed cabinet as recited in claim 3, wherein said legs are in the form of bellcranks pivotally mounted at their centers on shafts that pass through said mattress frame into cam means mounted on the inner surfaces of said mattress frame.

5. A portable folding bed cabinet as recited in claim 4, wherein said mattress frame has a recess formed in each of its opposite ends into which said legs withdraw when said mattress frame is pivoted to its vertical stored position.

6. A portable folding bed cabinet as recited in claim 5 wherein there are two mattress frames vertically spaced and pivotally attached to said vertically elongated frame that produce bunk beds when both frames are in their folded down position.

7. A portable folding bed cabinet as recited in claim 6 further comprising retainer frame means detachably secured to said top mattress frame.

* * * * *